US006489734B2

(12) United States Patent
Matsuura et al.

(10) Patent No.: US 6,489,734 B2
(45) Date of Patent: Dec. 3, 2002

(54) CATHODE RAY TUBE DEVICE

(75) Inventors: Shunsuke Matsuura, Osaka (JP); Asato Aoki, Kyoto (JP); Kazuhiro Sugimoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/843,384

(22) Filed: Apr. 25, 2001

(65) Prior Publication Data

US 2002/0017871 A1 Feb. 14, 2002

(30) Foreign Application Priority Data

Apr. 28, 2000 (JP) ..... 2000-129144

(51) Int. Cl.[7] ..... G09G 1/04
(52) U.S. Cl. ..... 315/364; 313/364
(58) Field of Search ..... 315/364, 366, 315/368.25, 368.28, 399, 1, 62, 111.51; 313/364, 2.1, 344, 412, 413; G09G 1/04

(56) References Cited

U.S. PATENT DOCUMENTS 3,851,215 A * 11/1974 Dekeijser et al. ..... 315/27 XY
4,636,693 A * 1/1987 Saruta ..... 315/368
5,350,973 A * 9/1994 Yokota et al. ..... 315/8
5,430,351 A * 7/1995 Yokota ..... 313/440
5,523,658 A * 6/1996 Fukuma et al. ..... 315/368.19

FOREIGN PATENT DOCUMENTS

JP 8-329859 12/1996 ..... H01J/29/76

* cited by examiner

*Primary Examiner*—Don Wong
*Assistant Examiner*—Trinh Vo Dinh
(74) *Attorney, Agent, or Firm*—Merchant & Gould P.C.

(57) ABSTRACT

A cathode ray tube device includes: a cathode ray tube with an envelope including a panel having a phosphor screen on its inner face and a funnel having a neck portion including an electron gun; and a deflection unit disposed around an outer face of the funnel. An inductance-adjusting element is provided therein for reducing an inductance at a frequency in an audio frequency band of at least one of a plurality of coils included in the deflection unit, and thereby noise is reduced that is generated by the at least one of the plurality of coils whose inductance is thus reduced.

5 Claims, 7 Drawing Sheets

CATHODE RAY TUBE DEVICE

BACKGROUND OF THE INVENTION

1. Field of the Invention

The present invention relates generally to a cathode ray tube device. More specifically, this invention relates to a cathode ray tube device with reduced beat noise caused by vibration generated in coils around a deflection yoke due to an alternating current flowing therein.

2. Related Background Art

Recently, display monitors have been increasingly improved in flatness and increased in size; such trends require strict convergence properties. On the other hand, with the spread of software that allows the information to be displayed at the periphery of a screen, users have been requesting very high levels of convergence properties.

Conventionally, magnetic fields generated by horizontal and vertical deflection coils of a deflection yoke have been controlled and adjusted so as to reduce misconvergence that mainly attributes to variations caused during assembly. This alone, however, hardly makes it possible to exclude misconvergence and therefore, a convergence correction unit or a distortion correction unit (a saturable reactor) is used for the purpose of controlling impedance of the deflection yoke to reduce misconvergence.

The convergence correction unit is housed in a two-part resin case 7 as shown in FIGS. 12A and 12B. The configuration of the convergence correction unit includes, as shown in FIG. 13, a control coil 1 connected in series with a vertical deflection coil and controlled coils 3 wound around four drum cores 5 disposed in pairs on both sides of the control coil 1, respectively. Magnets 6 magnetized in the thickness direction are attached to both outer sides of the drum cores 5 to apply a magnetic bias to the controlled coils 3. When a vertical deflection current flows therein, the control coil 1 vibrates, and thus beat noise is generated among the lead wires constituting the control coil 1, between the drum cores 5 and the lead wires, or between the control coil 1 and the case 7.

With regard to this beat noise, for instance, JP8-329859A discloses a method of reducing beat noise, wherein as shown in FIG. 13, a control coil 1 and controlled coils 3 are fixed to a case 7 through an adhesive 131 such as a silicone adhesive, so that the control coil 1 is kept out of contact with the case 7.

Although, this method can suppress the beat noise generated between the control coil 1 and the case 7, it cannot reduce directly the vibration of the noise source itself, namely, the control coil 1. Accordingly, it was not possible to suppress the beat noise generated by interference among lead wires or between the lead wire and a drum core 4.

Furthermore, the use of the adhesive 131 increases material and processing costs, which has been another disadvantage.

SUMMARY OF THE INVENTION

This invention is intended to solve such conventional problems as mentioned above. It is an object of the present invention to provide a cathode ray tube device in which vibration of a noise source itself such as a control coil is reduced by a simple and inexpensive method, and thus less beat noise is caused.

This invention achieves an improvement in a cathode ray tube device including: a cathode ray tube with an envelope composed of a panel having a phosphor screen on its inner face and a funnel having a neck portion provided with an electron gun; and a deflection unit having a plurality of coils and disposed around an outer surface of the funnel. In order to achieve the above-mentioned object, at least one of the coils of the deflection unit is provided with an inductance-adjusting element for reducing an inductance of the coil at a frequency in an audio frequency band so as to reduce noise that is generated by the coil whose inductance is thus reduced.

This configuration allows vibration of the control coil itself as a beat noise source to be reduced, and thereby, beat noise at a frequency of 200 Hz or higher can be reduced without using an adhesive such as a silicone adhesive.

In the above-mentioned configuration, the inductance-adjusting element can be a closed-loop coil that is coupled magnetically to the at least one of the plurality of coils included in the deflection unit and includes at least one turn of conductor. Thus, beat noise can be reduced by a simple and inexpensive method in which the closed-loop coil for beat-noise reduction is added.

In this configuration, the deflection unit can include a deflection yoke including a horizontal deflection coil and a vertical deflection coil, and auxiliary coils through which a current is passed in synchronization with a deflecting current. In the deflection unit, at least one of the horizontal deflection coil, the vertical deflection coil and the auxiliary coils can be coupled magnetically to the closed-loop coil.

With respect to the auxiliary coil, the auxiliary coil includes control coils of a convergence correction unit disposed on a side of the electron gun of the deflection yoke and connected in series with the horizontal deflection coil or the vertical deflection coil.

Furthermore, the auxiliary coil can include the control coil wound around a drum core and at least one pair of two-part controlled coils disposed on both sides of the control coil, and each of the two-part controlled coils is wound around drum cores other than the above-mentioned drum core around which the control coil is wound.

The aforementioned respective configurations allow the vibration of coils as beat noise sources other than a control coil to be reduced, and thus beat noise at a frequency of 200 Hz or higher can be reduced without using an adhesive such as a silicone adhesive.

DETAILED DESCRIPTION OF THE INVENTION

First Embodiment

Figure 3:
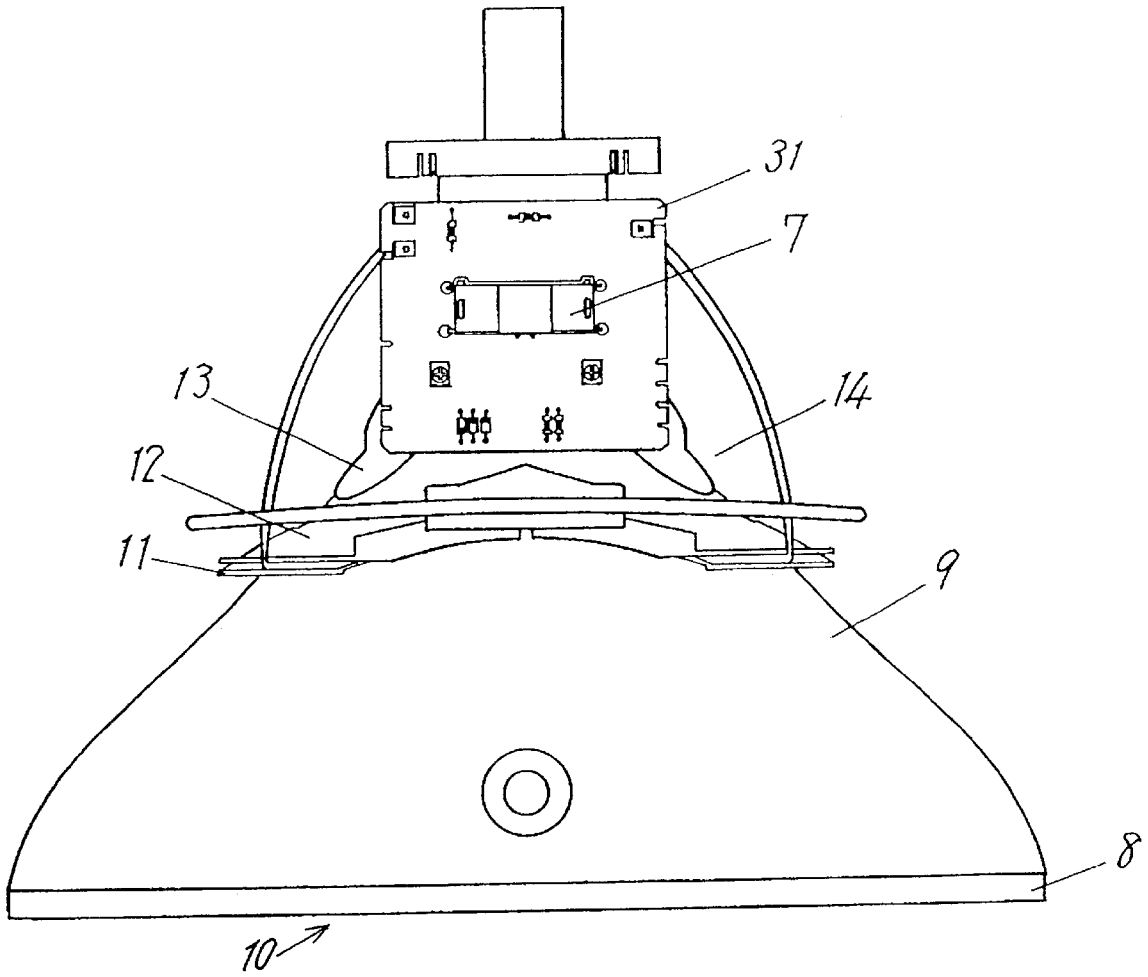
FIG. 3 is an external view of a color cathode ray tube device.

FIG. 3 shows the appearance of a cathode ray tube device according to an embodiment of the present invention. The cathode ray tube device includes a cathode ray tube body 10 having a glass panel 8 and a glass funnel 9 connected to the rear portion thereof, and an electron gun (not shown in the figure) provided in the rear portion of the cathode ray tube body. The cathode ray tube body 10 is furnished with a deflection yoke 14 including a horizontal deflection coil 11 provided around the periphery of the cathode ray tube body 10, an insulator 12 provided on the outer side of the horizontal deflection coil 11, a vertical deflection coil 13 provided on the outer side of the insulator 12, and a ferrite core. A circuit board 31 with various circuit components mounted thereon is fixed to the deflection yoke 14. A resin case 7 housing a convergence correction unit is disposed on the circuit board 31.

Figure 1:
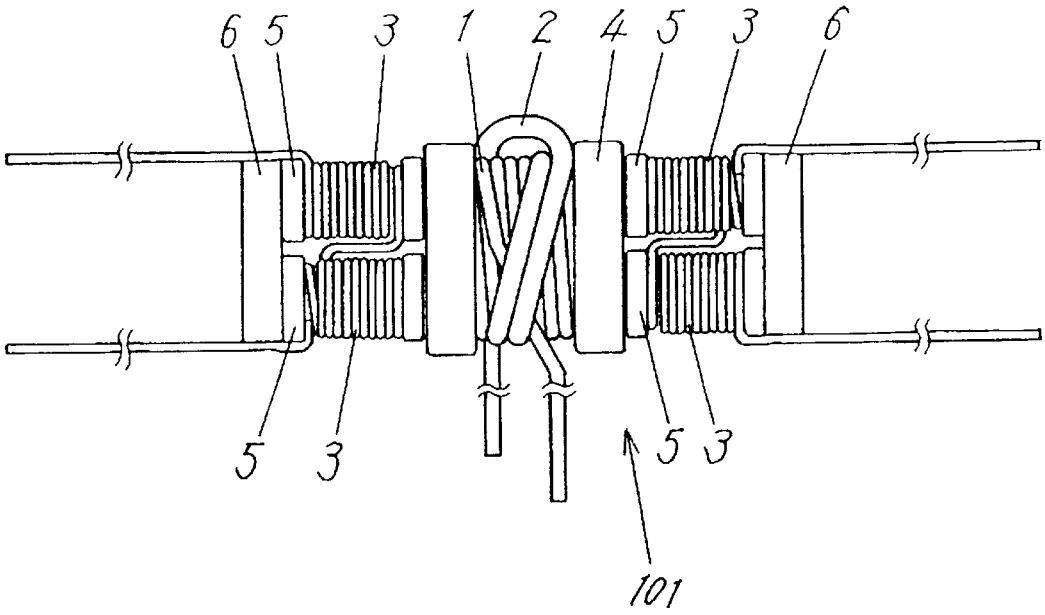
FIG. 1 is a plan view of a convergence correction unit according to a first embodiment of the present invention.
Figure 2:
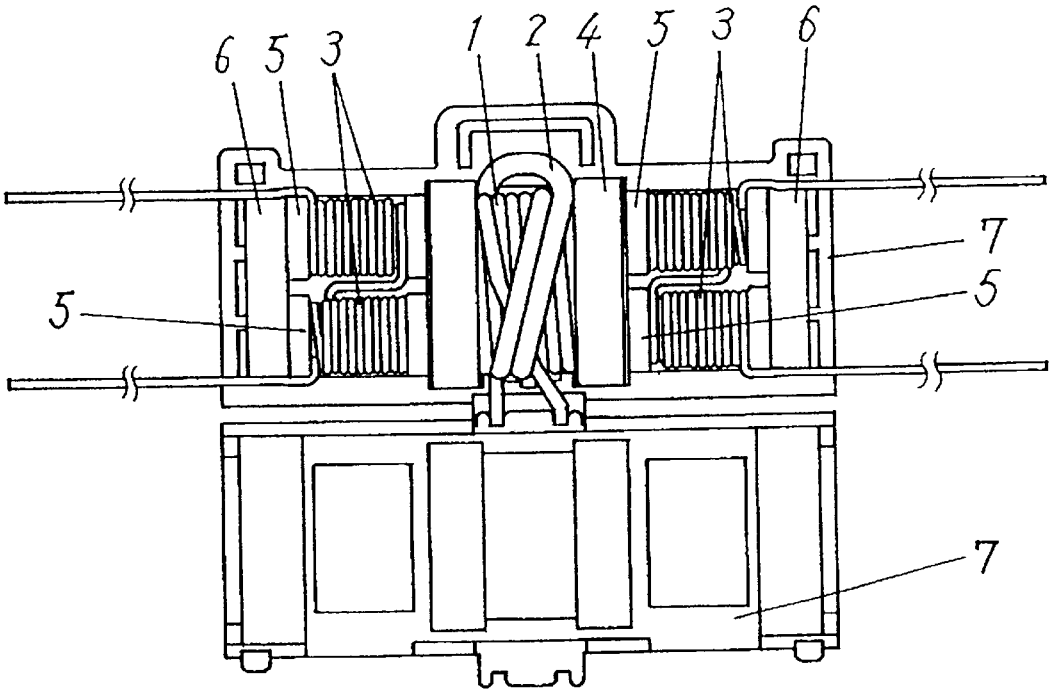
FIG. 2 is a plan view showing an opened resin case housing the convergence correction unit.

FIG. 1 shows a convergence correction unit. The convergence correction unit 101 includes, in its center, a control coil 1 and a beat-noise reducing coil 2 made of a closed-loop coil wound around the control coil 1. Although the beat-noise reducing coil 2 is formed of a wire, other ribbon-shaped conductors may be used in place of a wire as long as it is a conductor. A pair of controlled coils 3 is disposed on both sides of the control coil 1. The control coil 1 and the beat-noise reducing coil 2 are wound around a drum core 4. The control coil 1 is connected in series with a vertical deflection coil 13 of a deflection yoke 14, so that a vertical deflection current is supplied to the control coil 1. A current induced by a magnetic field generated by the control coil 1 flows in the beat-noise reducing coil 2.

Each of the controlled coils 3 is divided into two portions and each portion is wound around each of drum cores 5 disposed in parallel to the control coil 1. The controlled coils 3 are connected in series with a horizontal deflection coil 11 of the deflection yoke 14, so that a horizontal deflection current is supplied to the controlled coils 3. Magnets 6 magnetized in the thickness direction are attached to the outer ends of the drum cores 5 to apply a magnetic bias to the controlled coils 3.

The control coil 1, the beat-noise reducing coil 2, the controlled coils 3, the drum cores 4 and 5 with these coils wound therearound and the magnets 6 are handled as one unit and housed in the resin case 7 formed of a twofold article with an upper part and a lower part.

Figure 4:
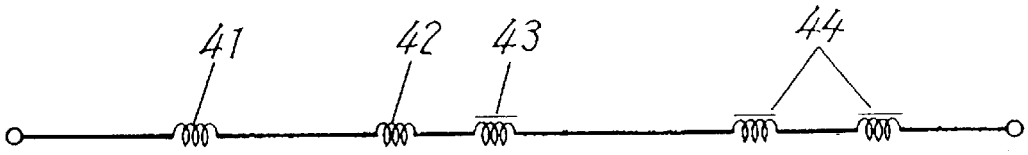
FIG. 4 is a connection diagram showing a vertical deflection system of the convergence correction unit.
Figure 5:
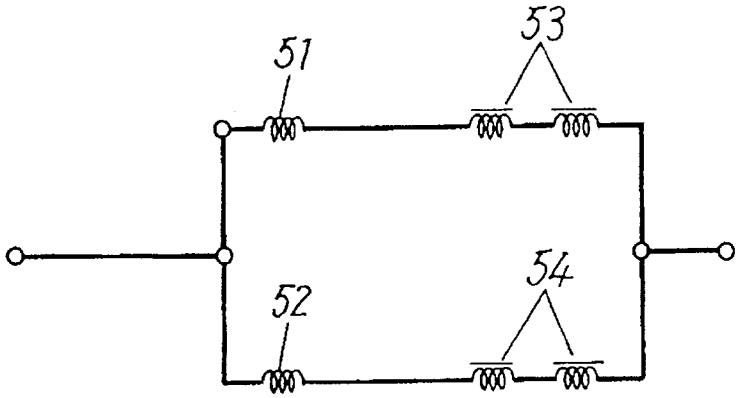
FIG. 5 is a connection diagram showing a horizontal deflection system of the convergence correction unit.

FIGS. 4 and 5 are diagrams showing connections of a vertical deflection system and of a horizontal deflection system in the convergence correction unit, respectively. In the vertical deflection system, saddle-shaped vertical deflection coils 41 and 42, a control coil 43, and coma correction coils 44 are connected in series. On the other hand, in the horizontal deflection system, a series circuit of a saddle-shaped horizontal deflection coil 51 and two controlled coils 53 is connected in parallel with a series circuit of a saddle-shaped horizontal deflection coil 52 and two controlled coils 54.

The following description is directed to details of a beat-noise reducing effect provided by the present invention.

A vertical deflection frequency of a display monitor is in the range of about 60 to 200 Hz. However, the vertical deflection current actually flowing in the deflection yoke contains high frequency components of a deflection current with a frequency of 200 Hz or higher in addition to the vertical deflection frequency. The high frequency components I of the deflection current consumes energy P in the coil portion having an inductance L in accordance with the following formula:

$$P=j\omega LI^2 \quad (1).$$

The energy P increases the temperature of the coils, vibrates lead wires, or turns into sound energy, and thus the energy P is consumed. When such energy to be consumed is reduced with respect to a high frequency band, beat noise can be reduced, accordingly. The beat-noise reducing coil 2 of the present invention provides an effect of reducing the inductance L of coils in a high frequency band of 200 Hz or higher, and thus reduces beat noise. The following description is directed to the principle of such beat noise reduction.

Figure 6:
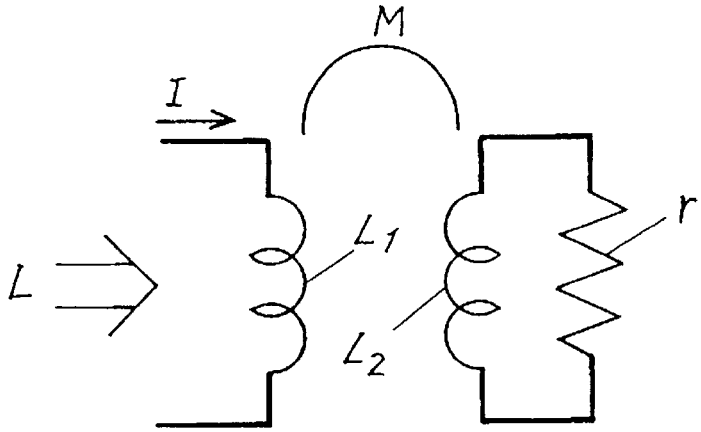
FIG. 6 shows the connection between a control coil and a beat-noise reducing coil.

In FIG. 6, a coil $L_1$ corresponds to the control coil 1 and a coil $L_2$ as a unit different from that of the coil $L_1$ corresponds to the beat-noise reducing coil 2. The coil $L_2$ is wound to be coupled magnetically to the coil $L_1$. The impedance Z of the whole of these coils is expressed as follows:

$$Z=j\omega L_1+(\omega^2M^2)/(j\omega L_2+r) \quad (2),$$

wherein M, ω, $L_1$, $L_2$, and r respectively indicate a mutual inductance, angular velocity, an inductance of the coil $L_1$, an inductance of the coil $L_2$, and resistance of the coil $L_2$. The inductance L of the whole of the coils is expressed by the following formula:

$$L=L_1-(\omega^2M^2L_2)/(r^2+\omega^2L_2^2) \quad (3).$$

Figure 7:
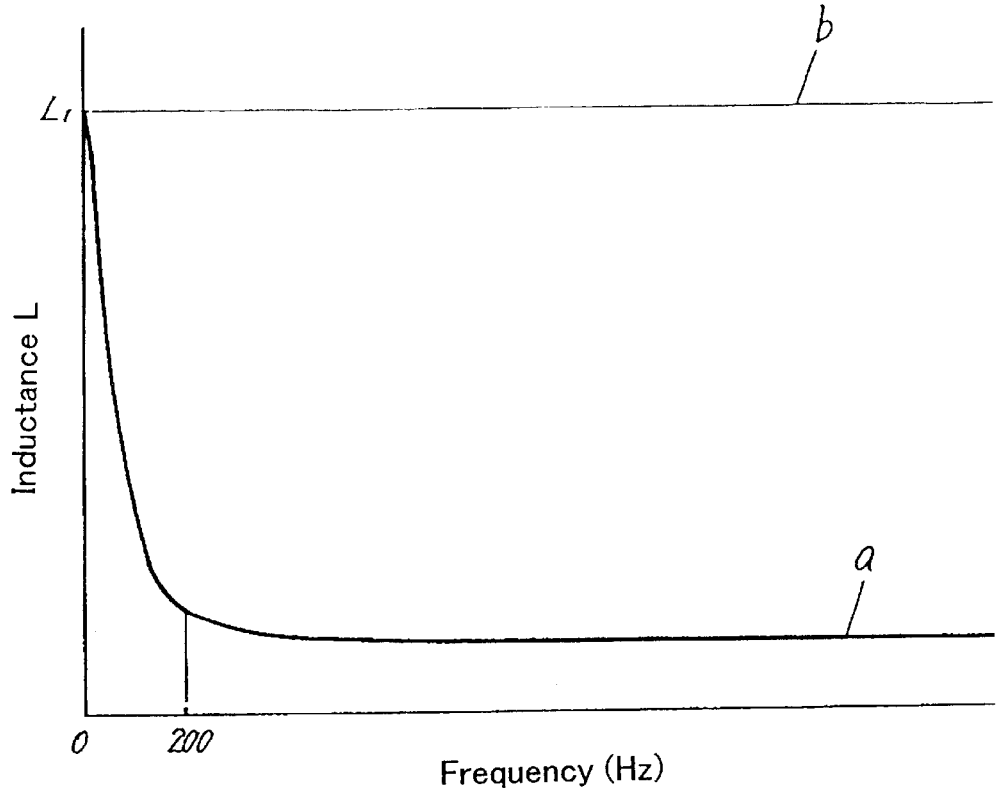
FIG. 7 is a graph showing the relationship between a frequency of a current flowing in the control coil and an inductance of the same.

FIG. 7 is a graph showing the relationship between a current frequency and the inductance of the whole of the coils. The inductance L has a frequency dependence such that the inductance L increases when the frequency is low, namely 200 Hz or lower, and decreases when the frequency is higher than 200 Hz. Therefore, with respect to high frequency components of the deflection current, the energy expressed by the formula (1) is restrained to a low level, so that the beat noise to be generated can be reduced. Further, as is apparent from the formula (3), lower resistance r allows lower inductances to be obtained at higher frequencies. Consequently, it is desirable that the coil $L_2$ has a larger diameter as long as it does not allow work efficiency to be worsened, for instance, in inserting coil wires into holes in a printed-circuit board.

Based on the principle mentioned above, the cathode ray tube device of the present invention successfully reduces beat noise by controlling the inductance L of the coils depending on the frequency.

With respect to a deflection current in a high frequency band with a frequency of 1 kHz or higher, which is a primary cause of the beat noise, owing to the beat-noise reducing coil 2 wound around the drum core 4, around which the control coil 1 also is wound, the inductance L decreases to one fifth to one tenth or less as compared to that in the case of a current with a vertical deflection frequency of about 120 Hz. Accordingly, the energy loss of the deflection current with a frequency in the high frequency band, which causes beat noise, vibration and heat, can be suppressed in the control coil.

The following description is directed to a specification of a convergence correction coil in a 51 cm, 90° cathode ray tube device as an embodiment of the present invention. The control coil 1 was 0.28 mm in diameter and consisted of 175 turns of wire. The beat-noise reducing coil 2 wound around the control coil 1 was 0.6 mm in diameter and consisted of 22 turns of wire. The inductance $L_1$ was 2000 $\mu$H and the inductance $L_2$ was 33.6 $\mu$H. The controlled coil 3 was consisted of 2.5 turns of seven litz wires with a diameter of 0.22 mm. The inductance L was 2000 $\mu$H at 120 Hz, while being 350 $\mu$H at 1 kHz.

Upon passing a deflection current through the cathode ray tube device with the above configuration, the vibration of the beat noise source, namely the control coil 1 and the drum core 4, is suppressed, and thus the beat noise can be reduced. When compared with the product according to the conventional technique using an adhesive, the above embodiment reduced beat noise to one seventh or less at a frequency of 10 kHz with a level of sound pressure imposed by the convergence correction coil lowered from 29 dB to 23 dB at a frequency of 10 kHz.

Figure 8:
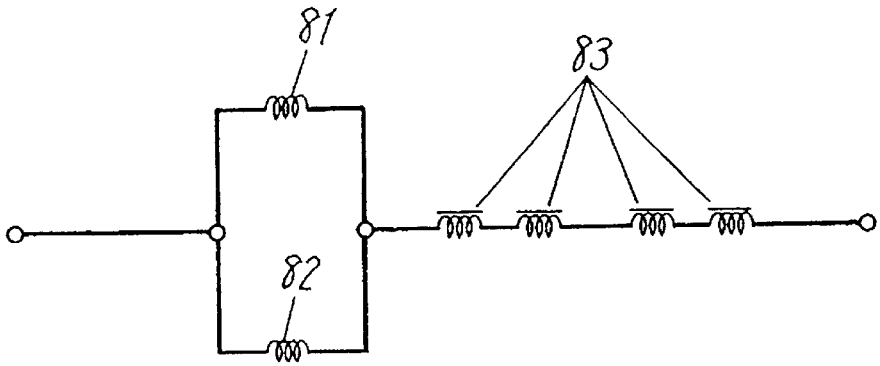
FIG. 8 is a diagram showing a connection in a horizontal deflection system of a distortion correction unit.
Figure 9:
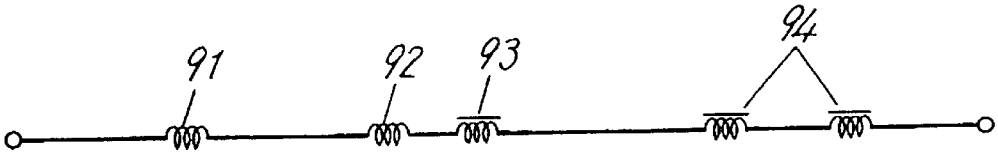
FIG. 9 is a diagram showing a connection in a vertical deflection system of the distortion correction unit.

Furthermore, two controlled coils of the convergence correction unit may be connected in series to be used as a distortion correction unit for correcting innerpincushion distortion. With respect to such a case, FIGS. 8 and 9 are diagrams showing connections in a horizontal deflection system and a vertical deflection system, respectively. In the horizontal deflection system, horizontal deflection coils 81 and 82 connected in parallel and four controlled coils 83 are connected in series. On the other hand, in the vertical deflection system, vertical deflection coils 91 and 92, a control coil 93 and a coma correction coil 94 are connected in series. Such a distortion correction unit also can give the same beat-noise reducing effect as that provided by the convergence correction unit by having a beat-noise reducing coil wound around the control coil.

In the first embodiment, the description was directed to the case where the beat-noise reducing coils were wound on the control coils of the convergence correction unit and the distortion correction unit. However, coils other than such control coils in a color cathode ray tube device also can be beat noise sources. Winding a beat-noise reducing coil on the other coils also can give the same beat-noise reducing effect as in the case of the convergence correction unit. In the following respective embodiments, the descriptions are directed to the cases where a beat-noise reducing coil is wound around a coma correction coil, a horizontal deflection coil and a vertical deflection coil.

Second Embodiment

A coma correction coil is provided on the electron gun side of a deflection yoke. This coma correction coil is connected in series with a vertical deflection coil and produces a pincushion-type magnetic field to correct a VCR convergence property. In this embodiment, a beat-noise reducing coil with both its ends short-circuited is wound on the coma correction coil.

The specification of the coma correction coil in a 51 cm, 90° cathode ray tube device is as follows. The coma correction coil consists of 110 turns of wire with a diameter of 0.4 mm and has an inductance $L_1$ of 473 $\mu$H. A beat-noise reducing coil consisting of 13 turns of wire with a diameter of 0.6 mm is wound on the coma correction coil and has an inductance $L_2$ of 9 $\mu$H. In this configuration, the inductances L at 120 Hz and 1 kHz are 473 $\mu$H and 165 $\mu$H, respectively. Thus, beat noise is hardly caused by the coma correction coil.

Third Embodiment

The following description is directed to the case where a beat-noise reducing coil is wound around a horizontal deflection coil.

Figure 10:
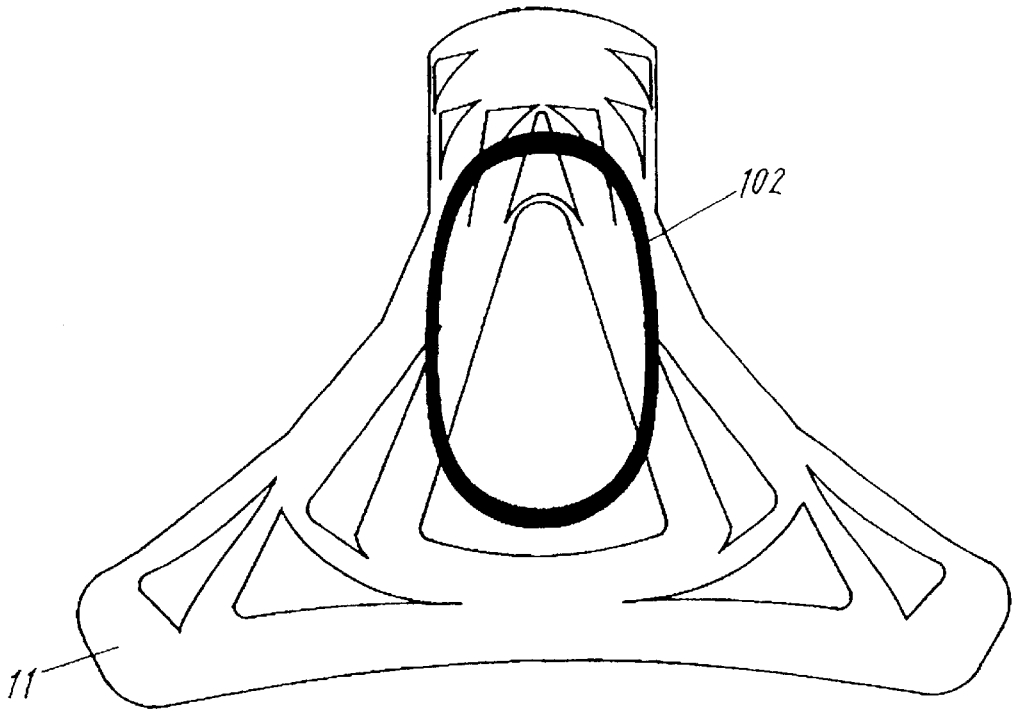
FIG. 10 shows the positional relationship between a horizontal deflection coil and a beat-noise reducing coil according to a third embodiment of the present invention.

FIG. 10 is a schematic view showing an example in which a beat-noise reducing coil 102 is applied to a horizontal deflection coil 11. The beat-noise reducing coil 102 including a closed-loop coil including at least one turn of wire is fixed so as to be placed along the outer or inner face of the horizontal deflection coil 11.

Fourth Embodiment

The following description is directed to the case where a beat-noise reducing coil is wound around a vertical deflection coil.

Figure 11:
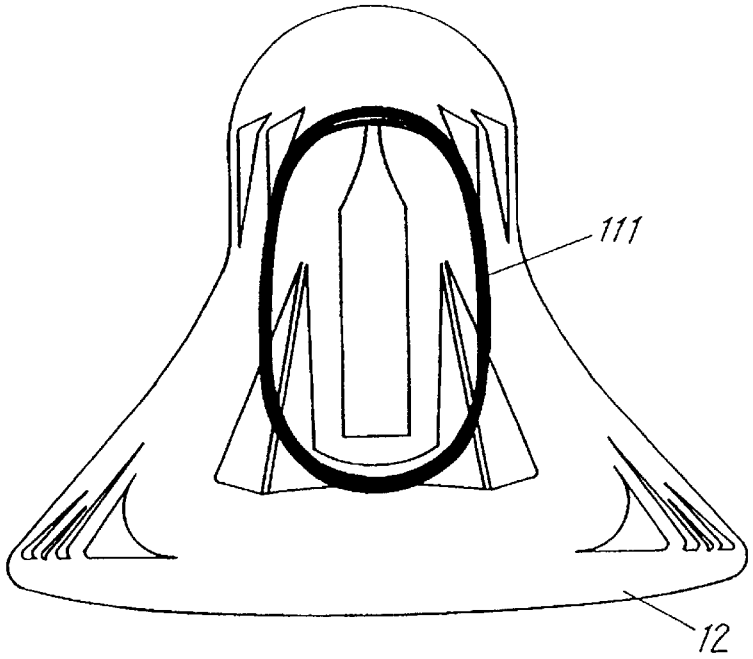
FIG. 11 shows the positional relationship between a vertical deflection coil and a beat-noise reducing coil according to a fourth embodiment of the present invention.
Figure 12B:
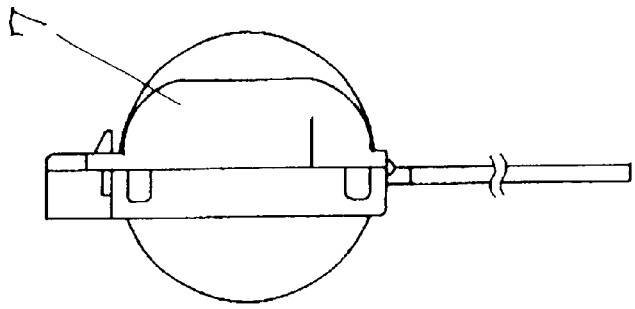
FIG. 12B PRIOR ART
FIGS. 12A and 12B are a front view and a side view showing the appearance of a resin case housing a conventional convergence correction unit, respectively.
Figure 12A:
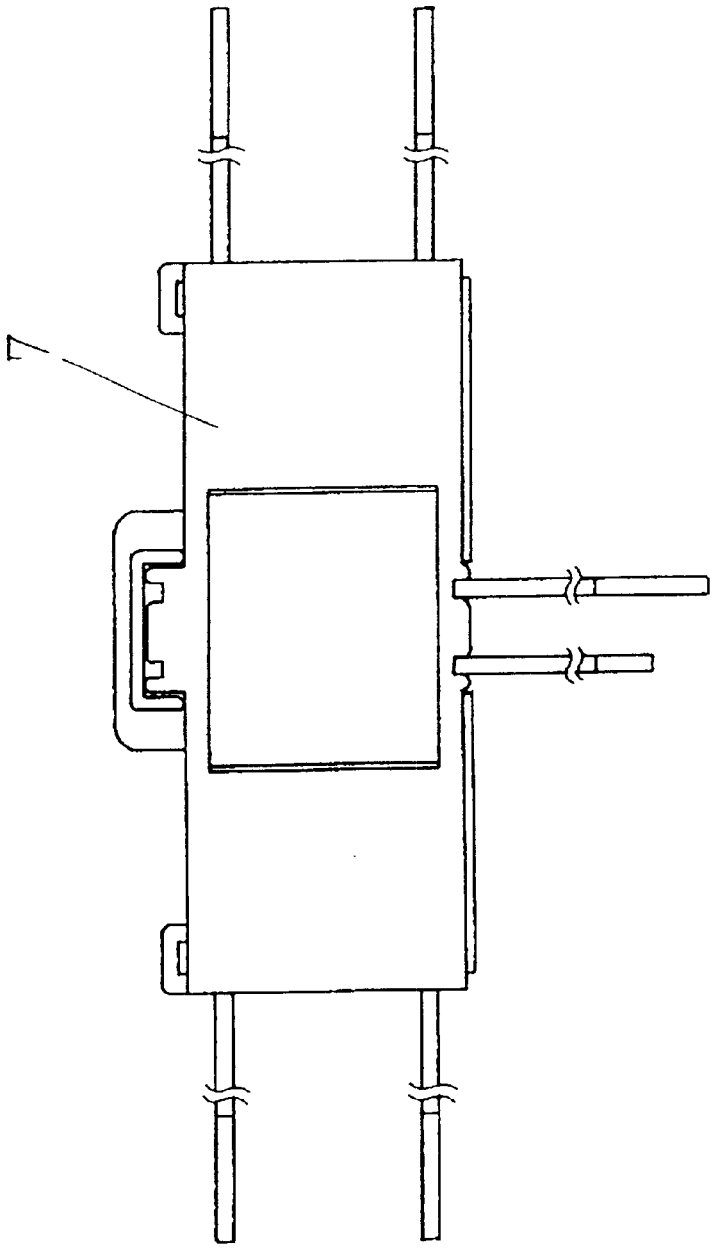
FIG. 12A PRIOR ART
Figure 13:
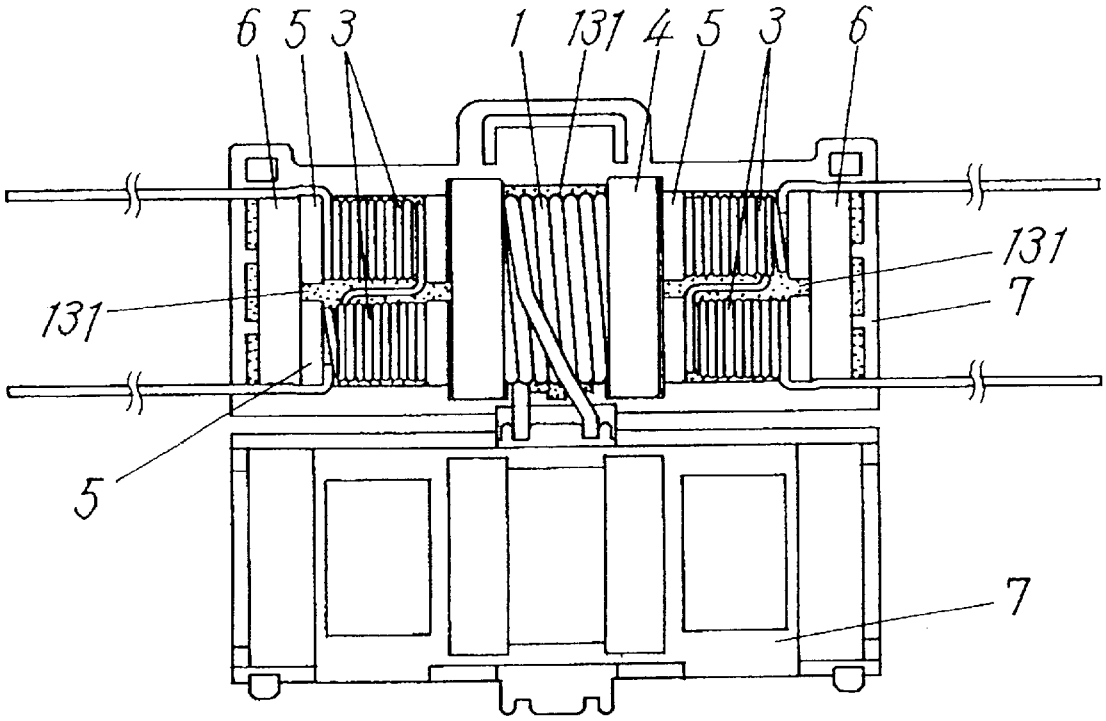
FIG. 13 PRIOR ART
FIG. 13 is a diagram showing the opened resin case housing the conventional convergence correction unit fixed thereto with an adhesive.

FIG. 11 is a schematic view showing an example in which a beat-noise reducing coil 111 is applied to a vertical deflection coil 12. The beat-noise reducing coil 111 including a closed-loop coil including at least one turn of wire is fixed so as to be placed along the outer or inner face of the vertical deflection coil 12.

The specification of horizontal and vertical deflection coils in a 51 cm, 90° cathode ray tube device is described as an example in the following. The horizontal deflection coil is made of 25 turns of wire and has an inductance $L_1$ of 80 $\mu$H. A beat-noise reducing coil consisting of 42 turns of wire with a diameter of 0.4 mm is wound around the horizontal deflection coil and has an inductance $L_2$ of 243 $\mu$H. In this case, the inductances L at 120 Hz and 1 kHz are 80 $\mu$H and 73 $\mu$H, respectively. The vertical deflection coil is made of 90 turns of wire and has an inductance of $L_1$ of 670 $\mu$H. As in the case of the horizontal deflection coil, a beat-noise reducing coil consisting of 42 turns of wire with a diameter of 0.4 mm is wound around the vertical deflection coil and has an inductance $L_2$ of 243 $\mu$H. In this case, the inductances L at 120 Hz and 1 kHz are 670 $\mu$H and 590 $\mu$H, respectively. Thus, beat noise hardly is caused by the horizontal and vertical deflection coils.

As described above, the cathode ray tube device of the present invention can provide an advantageous effect of reducing beat noise generated among lead wires, between the core and the lead wires, between the core and the case, and between the lead wires and the case since energy loss of a deflection current with a frequency in a high frequency band in the control coil can be reduced directly. Furthermore, material and processing costs can be reduced because it is no longer necessary to support coils with an adhesive as in the conventional technique.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube device comprising: a cathode ray tube with an envelope composed of a panel having a phosphor screen on an inner face of said phosphor screen and a funnel; and a deflection unit having a plurality of coils and disposed around an outer surface of the funnel;

wherein at least one of the coils of the deflection unit is provided with an inductance-adjusting element disposed along the external shape of the coil so that the element reduces an inductance of the coil at a frequency in an audio frequency band, thereby reducing noise that is generated by the coil whose inductance is thus reduced.

2. The cathode ray tube device according to claim 1, wherein the inductance-adjusting element is a closed-loop coil made of at least one turn of conductor and coupled magnetically to at least one of the plurality of coils of the deflection unit.

3. The cathode ray tube device according to claim 2, wherein the deflection unit comprises a deflection yoke including a horizontal deflection coil and a vertical deflection coil, and auxiliary coils through which a current in synchronization with a deflection current is passed, and at least one of the horizontal deflection coil, the vertical deflection coil, and the auxiliary coils is coupled magnetically to the closed-loop coil.

4. The cathode ray tube device according to claim 3, wherein one of the auxiliary coils comprises a control coil of a convergence correction unit connected in series with the horizontal deflection coil or the vertical deflection coil.

5. The cathode ray tube device according to claim 3, wherein one of the auxiliary coils comprises a control coil wound around a drum core and at least one pair of two-part controlled coils disposed on both sides of the control coil and each of the two-part controlled coils is wound around drum cores other than the drum core around which the control coil is wound.

* * * * *